US009951712B2

(12) United States Patent
Wicks

(10) Patent No.: US 9,951,712 B2
(45) Date of Patent: Apr. 24, 2018

(54) INTERNAL COMBUSTION ENGINE WITH INTERBORE COOLING

(71) Applicant: Ford Global Technologies, LLC, Dearborn, MI (US)

(72) Inventor: Christopher Donald Wicks, Allen Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 128 days.

(21) Appl. No.: 14/954,041

(22) Filed: Nov. 30, 2015

(65) Prior Publication Data

US 2017/0152809 A1 Jun. 1, 2017

(51) Int. Cl.

| | |
|---|---|
| ***F02F 1/14*** | (2006.01) |
| ***F01P 3/02*** | (2006.01) |
| ***F02F 11/00*** | (2006.01) |
| ***F02F 1/18*** | (2006.01) |

(52) U.S. Cl.

CPC ..... *F02F 1/14* (2013.01); *F02F 1/18* (2013.01); *F02F 11/002* (2013.01); *F02F 2200/06* (2013.01)

(58) Field of Classification Search

CPC .. F16J 15/0818; F02F 2001/104; F02F 1/166; F02F 2001/106; F01P 3/02

See application file for complete search history.

(56) References Cited

U.S. PATENT DOCUMENTS 3,410,256 A 11/1968 Herschmann
3,534,715 A 10/1970 Antonsen et al.
3,765,385 A 10/1973 Conrad
3,769,948 A 11/1973 Feichtinger et al.
4,917,169 A 4/1990 Melde-Tuczai et al.
5,474,040 A * 12/1995 Murakami ..... F02F 1/108 123/193.2
5,853,175 A * 12/1998 Udagawa ..... F16J 15/0825 277/595
5,873,163 A 2/1999 Diefenthaler et al.
6,138,619 A * 10/2000 Etemad ..... F01P 3/02 123/41.74
6,555,241 B1 * 4/2003 Erbsloh ..... C23C 14/0036 428/469

(Continued)

FOREIGN PATENT DOCUMENTS

JP H11294254 A 10/1999
JP 2003129903 A * 5/2003
JP 4591482 B2 12/2010

*Primary Examiner* — Long T Tran

(74) *Attorney, Agent, or Firm* — Brooks Kushman P.C.; Greg Brown

(57) ABSTRACT

An engine has a cylinder block with first and second cylinders separated by a bore bridge, and a block cooling jacket having a slot in the bore bridge and intersecting a block deck face. The engine has one of a cylinder head and a head gasket with a surface configured to mate with the block deck face, the surface having a tab sized to be received by the slot to form a cooling passage therebetween. An engine has a cylinder block with a block deck face defining a first cylinder and a second cylinder separated by an interbore region. The block is independent of a cylinder liner. The block forms a cooling jacket with a fluid passage surrounding the first and second cylinders and an open channel extending across the interbore region and intersecting the block deck face.

16 Claims, 6 Drawing Sheets

(56) References Cited

U.S. PATENT DOCUMENTS

| | | | | |
|---|---|---|---|---|
| 7,047,915 | B2 * | 5/2006 | Kawai | F01P 3/02 123/41.79 |
| 7,255,069 | B2 | 8/2007 | Liebert | |
| 7,513,237 | B1 | 4/2009 | Liebert | |
| 7,798,108 | B2 * | 9/2010 | Konishi | F02F 1/36 123/41.72 |
| 8,844,478 | B2 | 9/2014 | Roth | |
| 8,919,302 | B2 * | 12/2014 | Hamakawa | F02F 1/14 123/41.67 |
| 9,086,031 | B2 | 7/2015 | Williams et al. | |
| 2005/0235930 | A1 | 10/2005 | Xin | |
| 2005/0268868 | A1 * | 12/2005 | Kawai | F01P 3/02 123/41.31 |
| 2006/0102110 | A1 | 5/2006 | Takenaka et al. | |
| 2012/0132157 | A1 | 5/2012 | Matsuki et al. | |
| 2014/0331947 | A1 * | 11/2014 | Beyer | F01P 3/02 123/41.74 |
| 2015/0101551 | A1 | 4/2015 | Kawasaki et al. | |
| 2015/0247472 | A1 * | 9/2015 | Nomura | F01P 3/02 123/41.74 |

* cited by examiner

INTERNAL COMBUSTION ENGINE WITH INTERBORE COOLING

TECHNICAL FIELD

Various embodiments relate to cooling passages for a bore bridge between two cylinders in an internal combustion engine.

BACKGROUND

In a liquid-cooled engine, sufficient cooling may need to be provided to the bore bridge between adjacent engine cylinders. The bore bridge on the cylinder block and/or the cylinder head is a stressed area with little packaging space. In small, high output engines, due to packaging, the thermal and mechanical stresses may be increased. Higher bore bridge temperatures typically cause bore bridge materials to weaken and may reduce fatigue strength. Thermally weakened structure and thermal expansion of this zone may cause bore distortion that can be problematic to overall engine functionality such as, for example, piston scuffing, sealing functionality and durability of the piston-ring pack. Additionally, high temperatures at the bore bridge area also limit the reliability of the gasket in this zone, which in turn may cause combustion gas and coolant leaks, and/or reduced engine power output and overheating.

SUMMARY

In an embodiment, an engine is provided with a cylinder block having first and second cylinders separated by a bore bridge, and a block cooling jacket having a slot in the bore bridge and intersecting a block deck face. The engine has one of a cylinder head and a head gasket with a surface configured to mate with the block deck face, the surface having a tab sized to be received by the slot to form a cooling passage therebetween.

According to an embodiment, an engine is provided with a cylinder block having a block deck face, the block defining a first cylinder and a second cylinder separated by an interbore region. The block is independent of a cylinder liner. The block forms a cooling jacket with a fluid passage surrounding the first and second cylinders and an open channel extending across the interbore region and intersecting the block deck face.

According to yet another embodiment, a method of forming an engine is provided. A block preform is cast from a material comprising one of aluminum and an aluminum alloy, with the block preform defining cast-in passages for a cooling jacket and defining first and second unfinished cylinder bores having walls formed from the material. The first and second unfinished cylinder bores are adjacent to one another and separated by a bore bridge. An open channel is formed and extends across the bore bridge. The walls of the first and second unfinished cylinder bores are machined to form cylinder walls for a first and second cylinder of a block, respectively.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
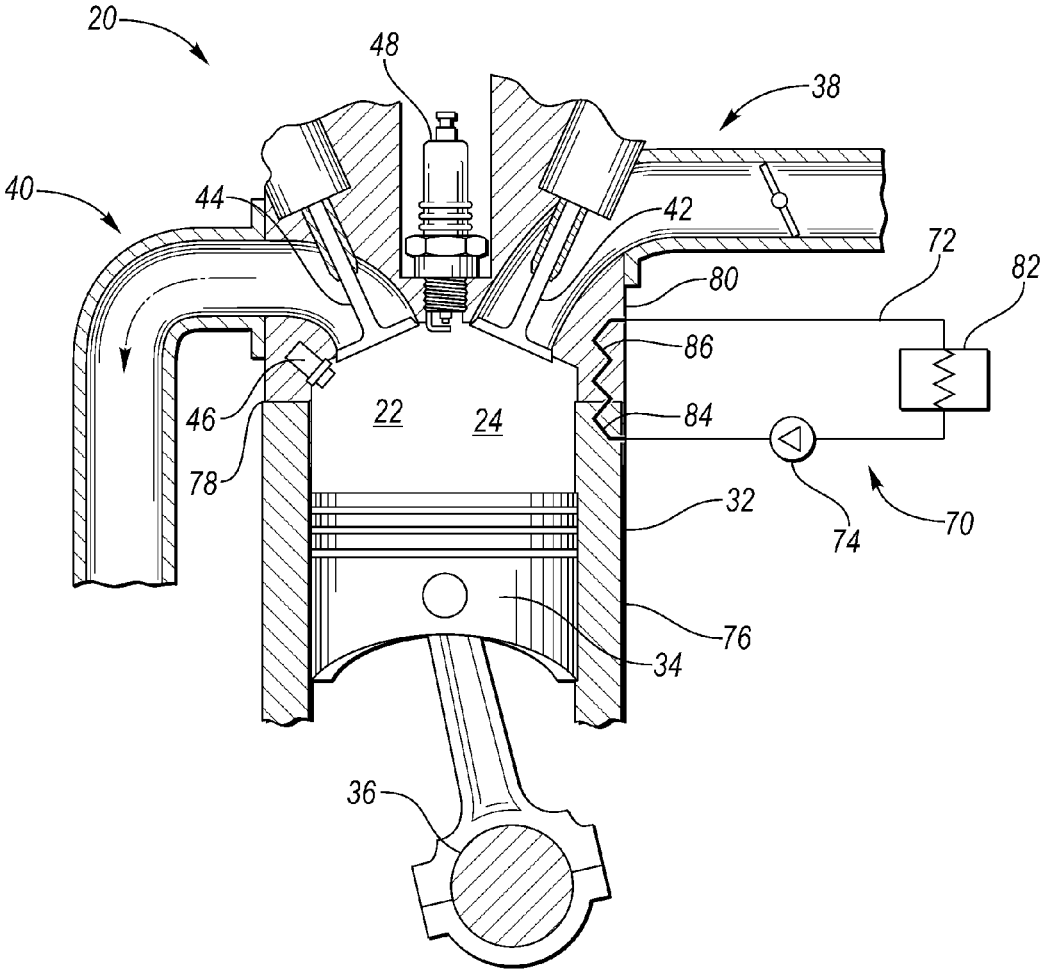
FIG. 1 illustrates a schematic of an engine configured to implement the disclosed embodiments.

FIG. 1 illustrates a schematic of an internal combustion engine 20. The engine 20 has a plurality of cylinders 22, and one cylinder is illustrated. The engine 20 has a combustion chamber 24 associated with each cylinder 22. The cylinder 22 is formed by cylinder walls 32 and piston 34. The piston 34 is connected to a crankshaft 36. The combustion chamber 24 is in communication with the intake manifold 38 and the exhaust manifold 40. An intake valve 42 controls flow from the intake manifold 38 into the combustion chamber 24. An exhaust valve 44 controls flow from the combustion chamber 24 to the exhaust manifold 40. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP) sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber 24. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an after treatment system such as a catalytic converter.

The intake and exhaust valve 42, 44 positions and timing, as well as the fuel injection timing and ignition timing may be varied as part of the engine control strategy.

The engine 20 includes a cooling system 70 to remove heat from the engine 20. The amount of heat removed from the engine 20 may be controlled by a cooling system controller or the engine controller. The cooling system 70 may be integrated into the engine 20 as a cooling jacket. The cooling system 70 has one or more cooling circuits 72 that may contain an ethylene glycol/water antifreeze mixture or another coolant as the working fluid. In one example, the cooling circuit 72 has a first cooling jacket 84 in the cylinder block 76 and a second cooling jacket 86 in the cylinder head 80 with the jackets 84, 86 in fluid communication with each other. The block 76 and the head 80 may have additional cooling jackets. Coolant, such as antifreeze, in the cooling circuit 72 and jackets 84, 86 flows from an area of high pressure towards an area of lower pressure.

The cooling system 70 has one or more pumps 74 that provide fluid in the circuit 72 to cooling passages in the cylinder block 76. The cooling system 70 may also include valves (not shown) to control to flow or pressure of coolant, or direct coolant within the system 70. The cooling passages in the cylinder block 76 may be adjacent to one or more of the combustion chambers 24 and cylinders 22, and the bore bridges formed between the cylinders 22. Similarly, the cooling passages in the cylinder head 80 may be adjacent to one or more of the combustion chambers 24 and cylinders 22, and the bore bridges formed between adjacent combustion chambers 24. The cylinder head 80 is connected to the cylinder block 76 to form the cylinders 22 and combustion chambers 24. A head gasket 78 is interposed between the cylinder block 76 and the cylinder head 80 to seal the cylinders 22. The gasket 78 may also have a slot, apertures, or the like to fluidly connect the jackets 84, 86, and selectively connect passages between the jackets 84, 86. Coolant flows from the cylinder head 80 and out of the engine 20 to a radiator 82 or other heat exchanger where heat is transferred from the coolant to the environment.

Figure 2:
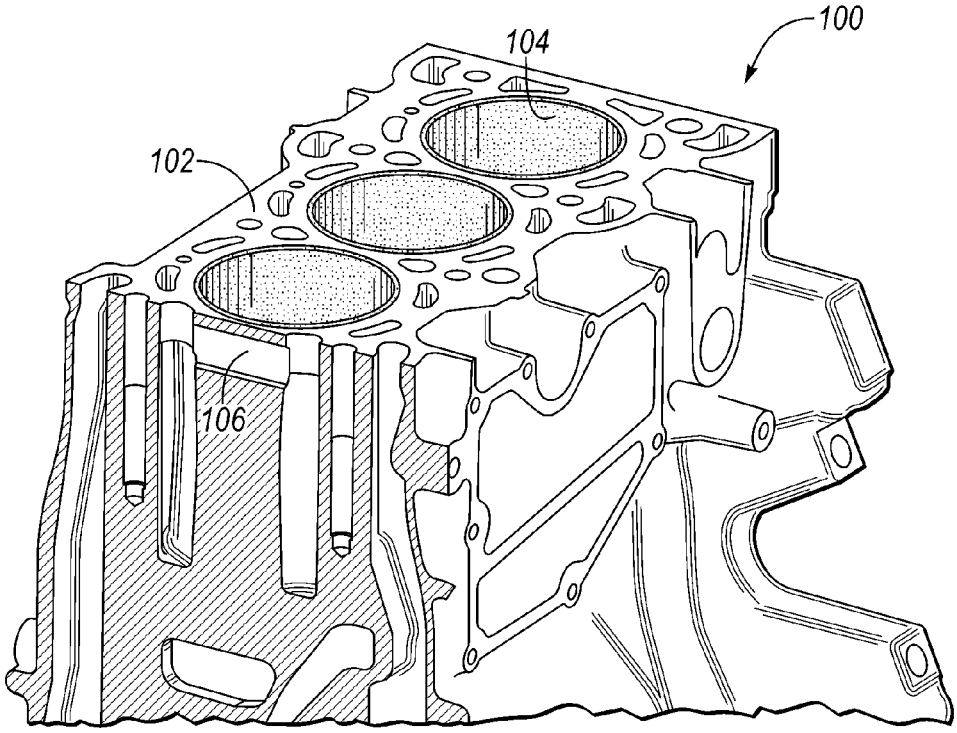
FIG. 2 (Prior Art)
FIG. 2 illustrates a perspective schematic view of a conventional engine block with an internal interbore cooling passage.

A conventional cylinder block 100 in an engine may be formed with a closed or semi closed deck 102, an example of which is shown in FIG. 2. The engine block may be cast, for example, using a sand casting process. The block has cylinder liners 104 formed from iron or another ferrous alloy, with the cast metal surrounding the liners. In one example, the cast metal is aluminum or an aluminum alloy. The cylinders may be aligned in an in-line configuration, with an interbore region or bore bridge between adjacent cylinders. An interbore cooling passage 106 may be cast into the block in the bore bridge region as an internal cooling passage.

Figure 3:
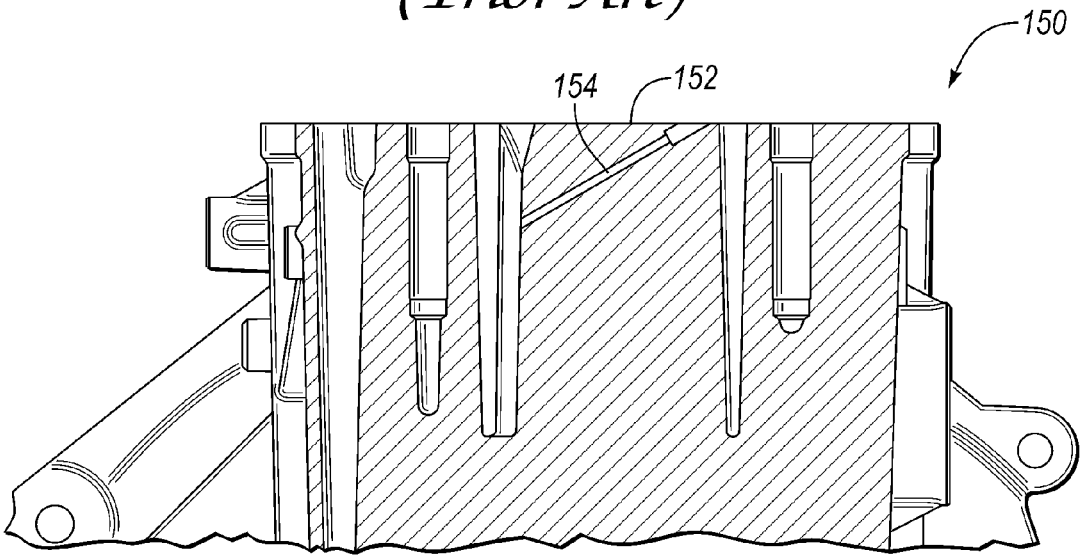
FIG. 3 (Prior Art)
FIG. 3 illustrates a partial sectional schematic view another conventional engine block with an internal interbore cooling passage.

Another conventional cylinder block 150 in an engine may be formed with an open deck or a semi-open deck, an example of which is shown in FIG. 3. The engine block may be cast, for example, using a die casting process. The block has cylinder liners (not shown) formed form iron or another ferrous alloy, with the cast metal surrounding the liners. In one example, the cast metal is aluminum or an aluminum alloy. The cylinders may be aligned in an in-line configuration, with an interbore region or bore bridge between adjacent cylinders. An interbore cooling passage may be formed, e.g. machined, into the block deck face in the bore bridge region as a cooling passage, for example, as an open channel or saw cut across the bore bridge, or as a drilled passage 154 provided across the bore bridge and at a nonparallel angle relative to the deck face 152.

In both of these conventional cylinder blocks, the cylinder liners provide for structural support of the block, particularly in the interbore region, as the dimensions may be small and on the order of millimeters. The iron or ferrous alloy liners help to reduce or prevent deformation and distortion of the cylinders caused by the high temperatures in the combustion chamber and the thermal load. The cylinder liners may reduce or prevent distortion in the interbore regions, as this is a high heat region in the block with little material, and is further structurally weakened with the bore bridge cooling passages.

Figure 4:
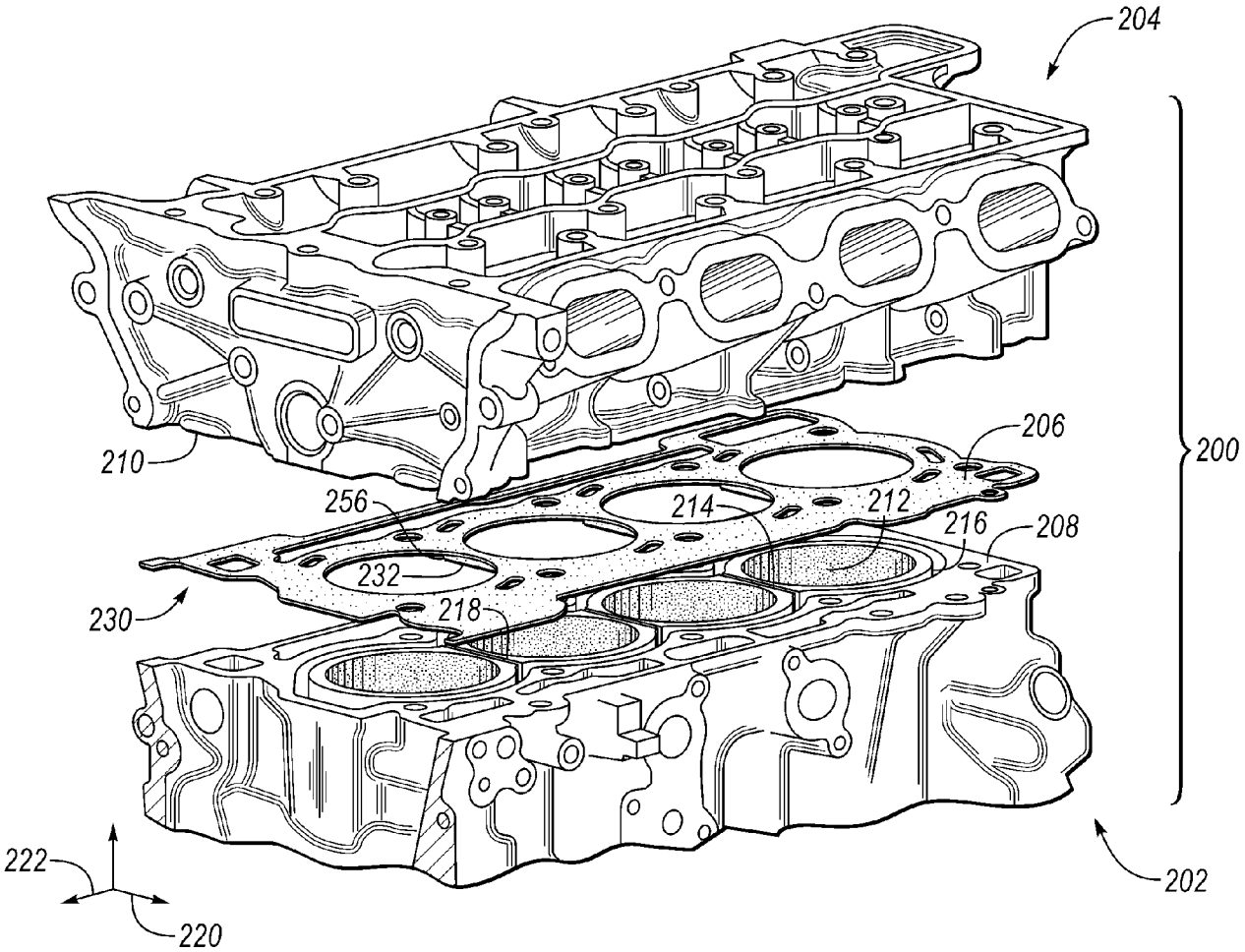
FIG. 4 illustrates an exploded perspective view of an engine according to an embodiment.
Figure 5:
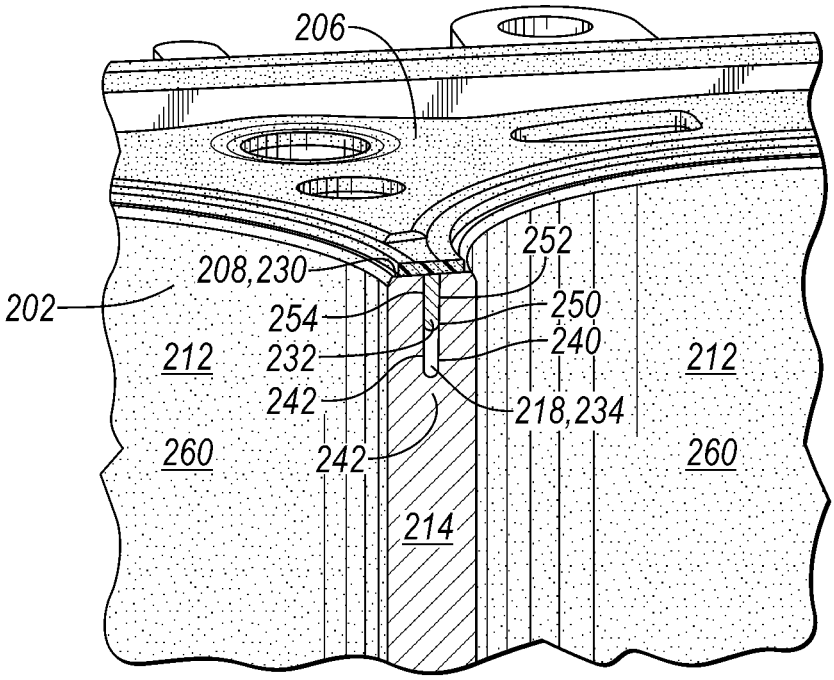
FIG. 5 illustrates a partial sectional view of the engine of FIG. 4.

FIGS. 4-5 illustrate an example of the present disclosure. FIG. 4 illustrates an exploded view of the engine 200 according to an embodiment. FIG. 5 illustrates a partial sectional view of the engine 200. Although the engine 200 is illustrated as an in-line, four cylinder engine, use of the disclosure with engines of other configurations is also contemplated.

The engine 200 may be the engine 20 as described above. The cylinder block 202 of the engine is connected to the cylinder head 204 using a head gasket 206 to form and seal a combustion chamber in the engine. The deck face 208 of the cylinder block 202 and the deck face 210 of the cylinder head 204 are in contact with first and second opposed sides of the gasket 206.

The cylinder block 202 has at least two bores 212, and the engine 200 is illustrated as an in-line four cylinder with four bores 212. Between adjacent cylinders or bores 212 in the block 202 are bore bridges 214, or interbore regions. The gasket 206 may include a bead on each side of the gasket and surrounding the chambers of the head 204 and cylinders 212 to help seal the combustion chambers of the engine 200.

Coolant flows into the engine 200, and may flow into a cooling jacket 216 surrounding the bores 212. The cooling jacket 216 may be a continuous channel surrounding a periphery, or circumferentially surrounding, the outer walls of the bores 212. The engine block 202 is illustrated as having an open or semi-open deck configuration. Coolant flows from the block cooling jacket 216, through various apertures, and may flow into one or more cooling jackets formed in the head 204.

The cylinders 212 are illustrated as having a siamese configuration. The interbore regions 214, or bore bridges, required cooling, as they are not in direct contact with the fluid in the jacket 216 passages, and experience high heat loads during engine 200 operation from combustion events.

An open channel 218, slot, or saw cut is provided in the interbore region 214. The open channel 218 may extend across the interbore region to fluidly connect the cooling jacket passages on opposed sides of the engine 200, e.g. the intake and exhaust sides. In other examples, the open channel 218 may extend across only a portion of the interbore region 214. The open channel 218 intersects the block deck face 208. The open channel 218 may have a uniform depth, or may vary in depth along the length of the channel 218. The channel 218 may extend along an axis 220 that is generally perpendicular to the longitudinal axis 222 of the engine 200. The open channels 218 between different bores 212 may be similar to one another, or may vary in size and shape, e.g., along the length of the engine to control interbore cooling to different bores, or based on changing coolant flow properties at different locations in the jacket 216.

In one example, as shown in FIGS. 4-5, the gasket 206 has a surface 230 configured to mate with the block deck face 208. A tab 232 or tongue extends outwards from the surface 230. The gasket 206 is provided with one tab 232 per channel 218 in the block 202. Each tab 232 is sized to be received by a corresponding slot 218 to form a cooling passage 234 therebetween. The cooling passage 234 is a cooling passage for the bore bridge or across the interbore region.

The slot or channel 218 has first and second opposed side walls 240, 242 extending from the deck face 208 to a base wall 244 or base of the slot. The base wall—244 is spaced apart from the deck face 208 and may be parallel with the deck face 208.

The tab 232 has an end wall 250 or apex connecting first and second opposed side walls 252, 254. The first and second side walls 252, 254 extend outwardly from the mating surface 230 of the gasket 206.

As can be seen from FIG. 5, the depth of the slot 218 is greater than the height of the tab 232 such that the base wall 244 of the slot and the end wall 250 of the tab are spaced apart from one another. The interbore cooling passage is defined by the base wall 244, the end wall 250, and portions of the side walls 240, 242.

The tab 232 may extend across the bore bridge such that it extends the length of the slot, as shown in FIG. 4. As such, the base wall 244 of the slot and the end wall 250 of the tab also extend across the bore bridge 214. The open channels 218 between different bores 212 may be similar to one another, or may vary in size and shape, e.g., along the length of the engine to control interbore cooling to different bores, or based on changing coolant flow properties at different locations in the jacket 216.

The first and second side walls 252, 254 of the tab 232 are configured to abut with the first and second side walls 240, 242 of the slot 218. The tab 232 may be sized such that the walls 252, 254 are closely fit within the walls 240, 242 of the slot 218 in a slight clearance fit, or a location or transition fit. The tabs 232 associated with different slots may be similar to one another, or may vary in size and shape, e.g., along the length of the engine to control interbore cooling to different bores, or based on changing coolant flow properties at different locations in the jacket 216.

The interbore cooling passage 234 provides for coolant flow across the bore bridge 214. The coolant flow may be generally parallel or parallel with the plane of the deck face 208. The coolant flow and cooling passage 234 is spaced apart from the deck face 208 to provide directed cooling to the cylinder bore 212 walls. In one example, the tab 232 or tongue fits or keys into the slot 218, and may fill approximately the upper half of the slot 218. In one example, the slot 218 has a depth of ten millimeters, and the tab has a height of five millimeters. This results in a cooling passage 234 of approximately five millimeters in height, and two millimeters in width. In other examples, the slot 218 is between 1-3 millimeters in width, or 1.5-2.5 millimeters in width, and has a depth of 7-15 millimeters.

The tab 232 has a first end 256 and a second opposed end. Each end 256 forms a portion of the wall for the jacket 216 cooling passage on each side of the interbore region 214 and on each side of the engine 200, e.g. the intake side and the exhaust side. The cooling passage 234 is fluidly connected with the cooling passage 216 on either or both sides of the engine 200 and interbore region 214. Of course, the various dimensions of the slot and the cooling passage 234 may be sized and constrained by the physical dimensions of the engine block 202 and bore 212 spacing.

The engine block 202 may be formed from aluminum or an aluminum alloy, for example, in a casting process such as a high pressure die casting process. The engine block 202 may be formed without cylinder liners such that the bulk cast metal provides the inner wall of the cylinder. The cast metal aluminum may be qualified, machined or otherwise processed to provide the surface finish and smoothness desired for a cylinder wall.

The bore 212 walls may be coated with another material to improve the surface properties of the cylinder wall. For example, the coating 260 may provide for reduced friction and/or wear, and may additionally modify the thermal properties of the surface. In one example, a ferrous alloy, such as steel, is spray coated onto the surface of the cast metal cylinder walls. In a further example, the steel coating 260 is plasma coated or plasma sprayed onto the cast aluminum bore wall. This results in an engine block with a spray bore configuration.

As the block 202 is without a conventional iron cylinder liner, or is independent of a liner, the block 202 does not have a structural component that is common in conventional engines. The open channel 218 may deform and be subject to distortion due to thermal loads and other engine loads during operation, especially due to the thin walled sections separating the combustion chamber from the open portion of the channel 218. The outward pressure in the combustion chamber of the cylinder 212 during the combustion event may cause unsupported, vertical side walls of the channel to deform or even fold over, resulting in possible engine performance degradation and sealing issues.

The tab 232, in addition to locating and partially defining the cooling passage 234 in the desired predetermined location, acts as a structural element or support element to reduce and prevent bore 212 distortion in the interbore region 214 and in the channel 218. The tab 232, acting under a compression load in the direction of the longitudinal axis 222, prevents the bore bridge 214 and channel 218 walls from deforming.

Figure 7:
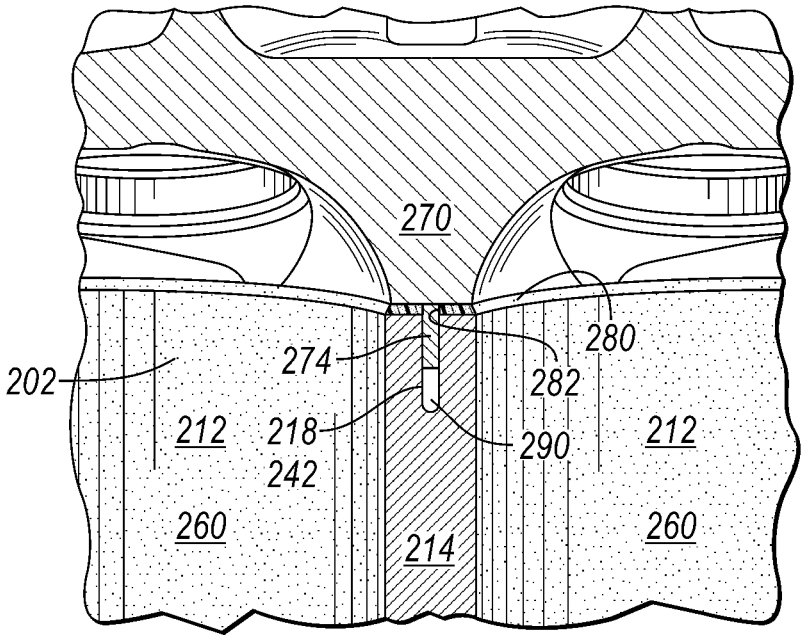
FIG. 7 illustrates a partial sectional view of an engine with the cylinder head of FIG. 6.
Figure 6:
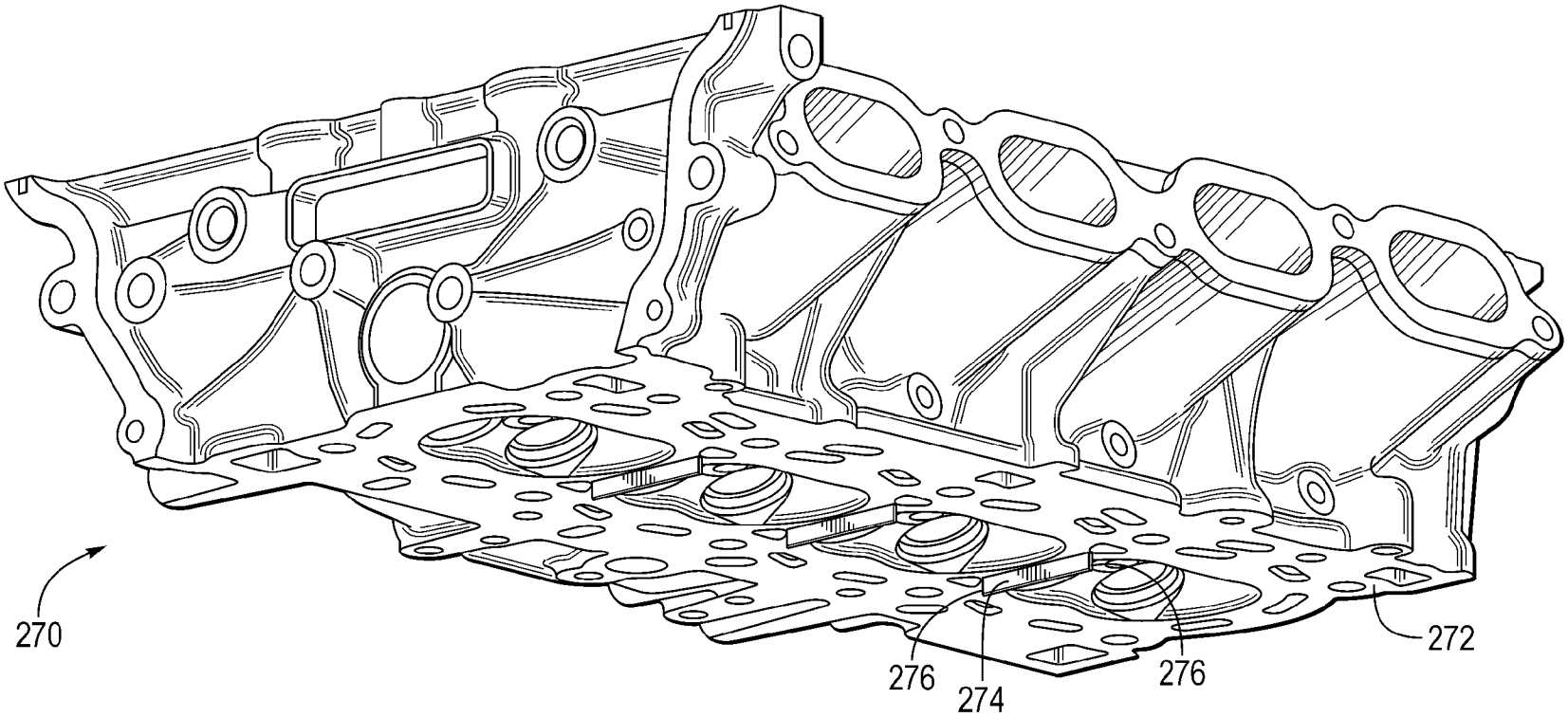
FIG. 6 illustrates a perspective view of a cylinder head for use with the engine block of FIG. 4.

In another example, as shown in FIGS. 6-7, the cylinder head 270 is configured for use with the block 202 of FIG. 4. The cylinder head 270 has a deck face 272 or a surface configured to mate or cooperate with the block deck face 208. A tab 274 or tongue extends outwardly and away from the surface 272, and in one example, is generally perpendicular to the surface. The head is provided with one tab 274 per channel 218 in the block. Each tab 274 is sized to be received by a corresponding slot 218 to form a cooling passage therebetween. The cooling passage is a cooling passage for the bore bridge or across the interbore region. As can be seen in FIG. 6, the tab 274 has opposed ends 276.

The gasket 280 is positioned between the block 202 and the head 270. The gasket 280 has an aperture 282 sized and shaped to closely fit about a periphery or a circumference of a base region of the tab 274. The perimeter of the aperture 282 may be substantially similar to the perimeter of the base of the tab 274. The apertures 282 are aligned with the tabs 274 such that each tab 274 extends through a corresponding aperture 282 when the engine is assembled, and the gasket 280 maintains the seal for the combustion chambers of the engine.

The tab 274 is similar to the tab 232 of the gasket as described above with respect to FIGS. 4-5. The tab 274 may have a greater height than the tab 232 to account for the thickness of the gasket 280 and provide a similar cooling passage size. As can be seen from FIG. 7, an interbore cooling passage 290 is provided by the slot 218 and the tab 274. The interbore cooling passage 290 is similar to passage 234 as described above. In addition to partially defining the cooling passage 290, the tab 274 acts as a structural element for the engine in the interbore region, as the engine block may be formed without cylinder liners, e.g., in a spray bore configuration.

Figure 8:
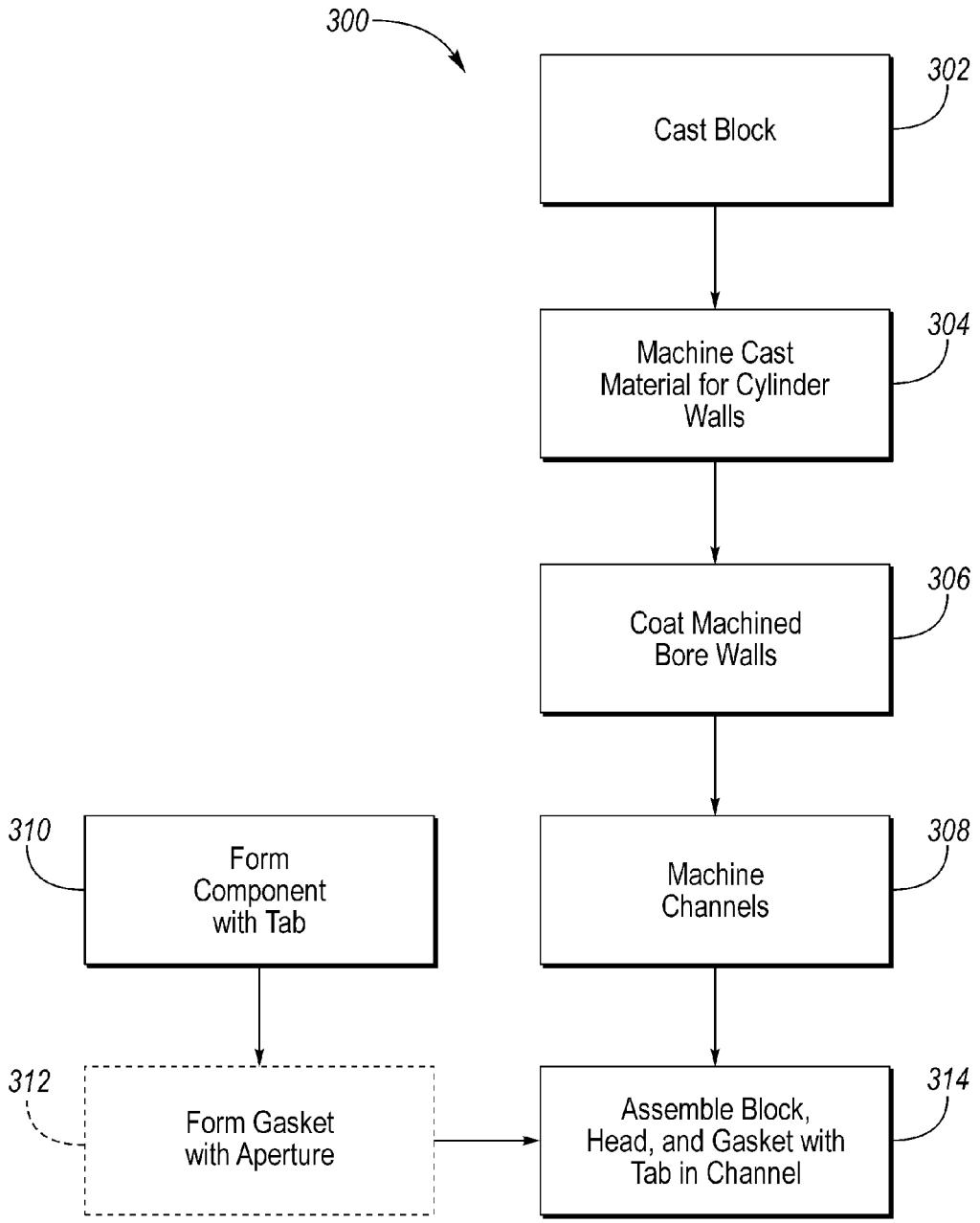
FIG. 8 illustrates a flow chart with a method of forming the engine according to an embodiment.

FIG. 8 illustrates a flow chart for a method 300 of forming and assembling an engine according to FIGS. 4-7. The method 300 may include greater or fewer steps than shown, the steps may be rearranged in another order, and various steps may be performed serially or simultaneously according to various examples of the disclosure.

At step 302, the block is formed. The block may be the block 202 as described above. The block may be formed from aluminum or an aluminum alloy, for example in a casting or die casting process. In one example, the block is formed from aluminum or an aluminum alloy in a high pressure die casting process. The casting process may include various dies, slides, lost cores, etc. to form the desired shapes, surfaces, and passages within the block, including the passages for the cooling jacket. The cylinder bores are also cast in with an unfinished surface wall. The walls of the cylinder bores are formed from the molten cast metal such that the block is formed without a liner, independent of a cylinder liner, or is linerless. In a high pressure die casting process, the molten metal may be injected into the tool at a pressure of at least 20,000 pounds per square inch (psi). The molten metal may be injected at a pressure greater than or less than 20,000 psi, for example, in the range of 15,000-30,000 psi, and may be based on the metal or metal alloy in use, the shape of the mold cavity, and other considerations. After the molten metal is cooled, a block preform is ejected or removed from the tool. The block preform has at least first and second unfinished cylinder bores separated by an interbore region or bore bridge.

At step 304, the unfinished cylinder bore walls of the block preform are qualified or machined to provide the cylinder walls, e.g., for a desired surface finish and shape, as a draft angle may be present.

At step 306, the qualified bore walls may be coated, for example, using a plasma spray coating process. In one example, the qualified bore walls are plasma spray coated with a steel coating or a ceramic coating.

At step 308, a channel, such as channel 218, may be formed or machined into the deck face and the interbore region. The open channel may be machined as a slot or a saw cut to extend across the bore bridge. In a further step, the saw cut may be qualified to at least a depth associated with the tab to provide the desired fit of the tab in the slot.

At step 310, an engine component is formed with a tab for each slot in the block. The component may be a head gasket as described above with respect to FIGS. 4-5. The gasket is formed with a surface configured to mate with a deck face of the block. For a head gasket, the tab may be formed from one or more layers of the gasket being bent, e.g. using a stamping process, or otherwise formed such that the tab extends outwardly from the mating surface of the gasket.

The component may also be a cylinder head as described above with respect to FIGS. 6-7. The head is formed with a head deck face or a surface configured to mate or correspond with a deck face of the block. The head may be cast or otherwise formed. In one example, the head is formed from aluminum or an aluminum alloy, for example, in a casting or die casting process. The tab may be formed to extend outwardly from the head deck face. In one example, the tab is at least partially formed during the casting process or forming process for the head. In another example, the tab may be at least partially formed when the head deck face is machined or otherwise finished. The tab may be qualified to a desired shape and size to fit the slot.

If the component is a cylinder head in step 310, a head gasket is formed in step 312. If the component is a gasket, the method proceeds directly from step 310 to 314, and uses a cylinder head formed with a flush deck face.

In step 312, a head gasket is formed for use with the cylinder head having tabs. The gasket is formed with an aperture for each tab, with the apertures sized such that the tab extend through the apertures, and the apertures are closely fit about a periphery of the base of each tab.

At step 314, the block, the head, and the gasket are assembled to form the engine. The tabs of the component are inserted into the slots or channels to cooperate and form an interbore cooling passage for the bore bridge. The interbore cooling passage is spaced apart from the deck face of the block. If the component is a cylinder head, each tab extends through a corresponding aperture in the gasket and is received into the channel in the block.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An engine comprising:

a cylinder block having first and second cylinders separated by a bore bridge, and a block cooling jacket having a slot intersecting a block deck face across a length of the bore bridge; and one of a cylinder head and a head gasket having a surface configured to mate with the block deck face, the surface having a tab sized to be received by the slot to form a cooling passage therebetween.

2. The engine of claim 1 wherein the slot is formed by first and second opposed side walls extending from the block deck face to a base wall of the slot;

wherein the tab has an end wall connecting first and second opposed side walls, the first and second side walls extending outwardly from the mating surface;

wherein the base wall of the slot and the end wall of the tab extend across the length of the bore bridge; and wherein the base wall of the slot and the end wall of the tab are spaced apart from one another.

3. The engine of claim 2 wherein the base wall of the slot and the end wall of the tab are parallel.

4. The engine of claim 2 wherein the first and second side walls of the tab are configured to abut the first and second side walls of the slot.

5. The engine of claim 1 wherein the tab is sized for a close fit with the slot.

6. The engine of claim 1 wherein the one of the cylinder head and the gasket is a cylinder head, the engine further comprising:

a head gasket positioned between the deck face of the block and the surface of the cylinder head, the gasket forming an aperture sized for the tab to extend through.

7. The engine of claim 1 wherein an apex of the tab is spaced apart from a base of the slot such that the cooling passage is at least partially defined by the apex and the base.

8. The engine of claim 1 wherein the slot extends across the length of the bore bridge to fluidly connect a passage in the cooling jacket on an intake side of the block with a passage in the cooling jacket on an exhaust side of the block.

9. The engine of claim 8 wherein the tab extends across the length of the bore bridge such that a first end forms a portion of a wall for the cooling passage on the intake side, and a second end forms a portion of another wall of the cooling passage on the exhaust side.

10. The engine of claim 1 wherein the first and second cylinder are each defined by a cylinder wall formed by a bulk material of the block.

11. The engine of claim 10 wherein a surface of each cylinder wall has a coating thereon.

12. The engine of claim 11 wherein the coating comprises a plasma coating.

13. An engine comprising:

a cylinder block having a block deck face, the block having an interbore region separating first and second cylinders, the block being independent of a cylinder liner, the block forming a cooling jacket with a fluid passage surrounding the first and second cylinders and an open channel intersecting the block deck face across a length of the interbore region and fluidly connecting the fluid passage on opposed sides of the interbore region.

14. The engine of claim 13 further comprising a cylinder head having a head deck face configured to cooperate with the block deck face, the head deck face having a tab extending outwardly therefrom, the tab sized to be received within the open channel to form a fluid passage therebetween, an apex of the tab being spaced apart from a base of the open channel.

15. The engine of claim 14 further comprising a gasket having a first side configured to cooperate with the block deck face and a second opposed side configured to cooperate with the head deck face, the gasket defining an aperture extending between the first and second sides, a perimeter of the aperture corresponding with a perimeter of the tab such that the tab extends through the aperture and into the open channel.

16. The engine of claim 13 further comprising a gasket having a block side surface configured to cooperate with the block deck face, the block side surface having a tab extending outwardly therefrom, the tab sized to be received within the open channel to form a fluid passage therebetween, an apex of the tab being spaced apart from a base of the open channel.

* * * * *